US005540610A

United States Patent [19]

Sneddon

[11] Patent Number: 5,540,610

[45] Date of Patent: Jul. 30, 1996

[54] FLYING DISC WATER TOY

[75] Inventor: Thomas M. Sneddon, Encino, Calif.

[73] Assignee: Mattel, Inc., El Segundo, Calif.

[21] Appl. No.: 335,646

[22] Filed: Nov. 8, 1994

[51] Int. Cl.[6] ..... A63H 27/00; A63H 3/52

[52] U.S. Cl. ..... 446/46; 446/236; 446/267

[58] Field of Search ..... 446/34, 46, 47, 446/48, 68, 267, 236, 486, 475; 273/424, 428, DIG. 4, DIG. 5; 238/211

[56] References Cited

U.S. PATENT DOCUMENTS

| | | | |
|---|---|---|---|
| 3,359,678 | 12/1967 | Headrick . | |
| 3,710,505 | 1/1973 | Linenfelser . | |
| 3,792,549 | 2/1974 | Lemelson | 446/179 |
| 3,831,209 | 8/1974 | Clingman . | |
| 3,855,728 | 12/1974 | Hynds . | |
| 4,157,632 | 6/1979 | Everett . | |
| 4,176,843 | 12/1979 | DeWitt, Jr. | 446/46 |
| 4,196,540 | 4/1980 | Hembree et al. . | |
| 4,205,484 | 6/1980 | Kovac et al. . | |
| 4,205,785 | 6/1980 | Stanley | 219/211 X |
| 4,274,591 | 6/1981 | Sunshine et al. | 239/211 X |
| 4,356,660 | 11/1982 | O'Brien . | |
| 4,378,653 | 4/1983 | O'Brien | 446/46 |
| 4,568,297 | 2/1986 | Dunipace | 446/46 |
| 4,820,230 | 4/1989 | Richards | 446/46 X |
| 4,979,922 | 12/1990 | Clark . | |
| 5,020,808 | 6/1991 | Richards . | |
| 5,041,042 | 8/1991 | Stein . | |
| 5,080,623 | 1/1992 | Stein . | |
| 5,116,275 | 5/1992 | Sassak . | |
| 5,279,641 | 1/1994 | Gable et al. | 446/46 |
| 5,288,256 | 2/1994 | Lee et al. | 446/267 X |
| 5,348,509 | 9/1994 | Riccardi et al. . | |

*Primary Examiner*—Robert A. Hafer
*Assistant Examiner*—D. Neal Muir
*Attorney, Agent, or Firm*—Kolisch, Hartwell, Dickinson, McCormack & Heuser

[57] ABSTRACT

A flying disc water toy is described. The toy preferably is circularly disc-shaped and includes a hard body, or upper external layer of closed-cell polymer foam material and an adhered soft body, or lower external layer of open-cell polymer having relatively defined fluid carrying capacity. The upper body preferably forms a relatively thin outer shell that extends laterally, through a smooth curve defining a peripheral region and then downwardly to provide a circularly air-confrontative airfoil providing substantial lift. The lower body preferably forms a relatively thick inner liner that extends substantially coextensively with the outer shell, and terminates in a circular edge or frusto-conical shaped radiating edge that inclines downwardly and inwardly from the terminal lower edge of the outer shell. The preferably forty-five degree (45°) inclined edge of the lower body cooperates with the smoothly rounded peripheral region of the upper body to produce a controlled, even dispersal in a pinwheel pattern of water absorbed and contained within the lower body during the spinning flight of the thrown flying disc water toy. In a preferred embodiment, the disc has a substantially uniform thickness over its entire extent, with the upper body itself preferably being a laminate of an outer ethylene-vinyl-acetate (EVA) foam layer and an inner cross-linked polyethylene foam layer, and with the lower body preferably being a polyurethane foam layer.

6 Claims, 2 Drawing Sheets

FLYING DISC WATER TOY

BACKGROUND AND SUMMARY OF THE INVENTION

The present invention relates generally to recreational devices such as flying or throwing discs. More particularly, it concerns such a throwing disc that is usable in or near a body of fluid such as water to absorb, carry and then to radially disperse water to the delight of thrower, catcher and spectator.

Rigid flying discs that provide for throwing and catching recreation, with a flick of the thrower's wrist imparting a spin that enhances the flying disc's aerodynamics, are well known. Floppy water toys made of sponge or other fluid-absorbent material also are well known. The two have never been usefully combined to form a spinning, flying disc water toy for use in a body of water like a swimming pool, the disc providing good aerodynamic lift and yet being capable of evenly dispersing water carried thereby throughout a major portion of its flight.

The invented toy preferably is circularly disc-shaped and includes a hard body or upper external layer of closed-cell polymer foam material and an adhered soft body, or lower external layer of open-cell polymer having a relatively large defined fluid carrying capacity. The upper body is preferably fluid nonabsorbent and forms a relatively thin outer shell that extends laterally, through a smooth curve defining a peripheral region and then downwardly to provide a circularly air-confrontative airfoil providing substantial lift. The lower body preferably forms a relatively thick inner liner that extends substantially coextensively with the outer shell, and terminates in a circular edge or frusto-conical shaped radiating edge that inclines downwardly and inwardly from the terminal lower edge of the outer shell. The preferably forty-five degree (45°) edge of the lower body cooperates with the smoothly rounded peripheral region of the upper body to produce a controlled, even dispersal in a pinwheel pattern of water absorbed and contained within the lower body during the spinning flight of the thrown flying disc water toy. In a preferred embodiment, the disc has a substantially uniform thickness over its entire extent, with the upper body itself preferably being a laminate of an outer ethylene-vinyl-acetate (EVA) foam layer and an inner cross-linked polyethylene foam layer, and with the lower body preferably being a polyurethane foam layer.

The disc is provided with a concave upper surface and corresponding convex lower surface which act in cooperation with the smoothly curved peripheral region to provide an easily grippable surface. This surface better conforms to the shape of the hand in order to make the disc easier to throw and catch. Additionally, the use of soft foam materials for the toy decreases the danger of injury to persons or damage to property.

An appreciable advantage of the invention is the ability of the toy to maintain extended and stable flight while fully saturated with fluid. It has been found that a flying disc made solely of spongy absorbent material exhibits unstable flight characteristics due in part to deformations in the soft airfoil surface. Such all wet water toys are ideas which just do not fly. The addition of a substantially rigid support layer has been found to increase the rigidity of the airfoil and thereby improve the toy's stability while in flight. Though preferably placed over the top of the absorbent material, the rigid support layer may also be bonded underneath or even interior of the absorbent material.

A further advantage of the present invention is the even dispersal of water throughout the flight of the disc due to water flow control mechanisms engineered into the toy. The rate of fluid dispersal from the toy is regulated by three main factors: the absorption characteristics of the absorbing layer, the curvature of the impermeable laminate layer, and the rate of rotation of the disc. If the rate of water dispersal were unregulated, the water would simply splash out uncontrolled during the first rotation or flick of the wrist.

In the preferred embodiment, the capillary action of the open-cell polymer acts to absorb the fluid. The use of a denser open-cell foam exhibiting greater capillary fores will serve to increase water retention within the toy resulting in reduced fluid dispersion during each throw but increasing the number of times the toy may be thrown before reabsorption. The curvature of the downwardly depending impermeable periphery of the laminate acts as a centripetal force, governing the action that the centrifugal forces have on the absorbed fluid within a spinning disc. It is thought that a shallower curvature will make it easier for fluid collected within the peripheral edges of the absorbent layer to be released and radiated outwardly. Finally, the rate of spin imparted to the disc will effect the centrifugal forces acting upon the absorbed fluid such that a thrower who is able to toss the toy with a greater rate of rotation will be able to increase the amount of water being dispersed from the toy. Thus, the dispersion characteristics of the flying water toy may be varied both by manufacturers in their choice of fluid absorbing materials and laminate shape and by the skill of the thrower in providing rotation to the disc.

These and additional objects and advantages of the present invention will be more readily understood after a consideration of the drawings and the detailed description of the preferred embodiment.

DETAILED DESCRIPTION OF THE PREFERRED EMBODIMENT

Figure 1:
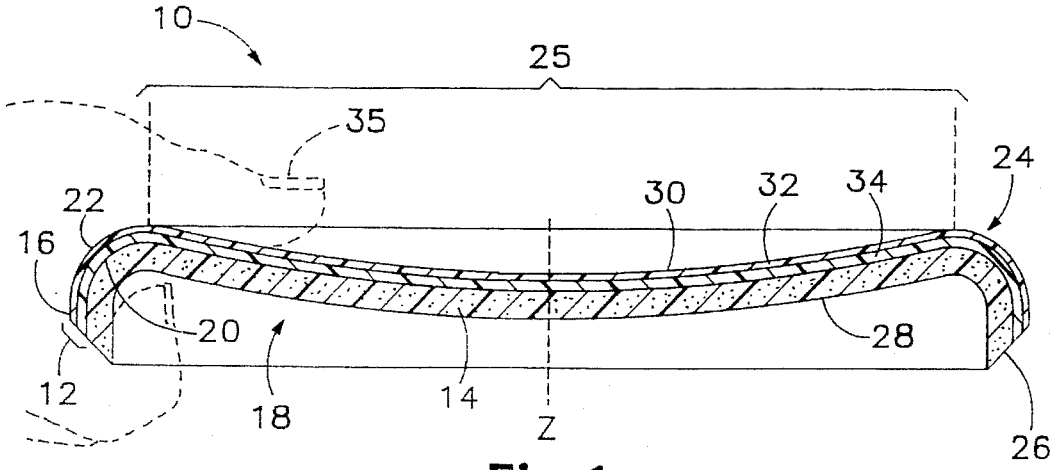
FIG. 1 is a front cross-sectional elevation of the flying disc water toy made in accordance with its preferred embodiment. A hand is shown in dashed outline gripping the disc for throwing.
Figure 2:
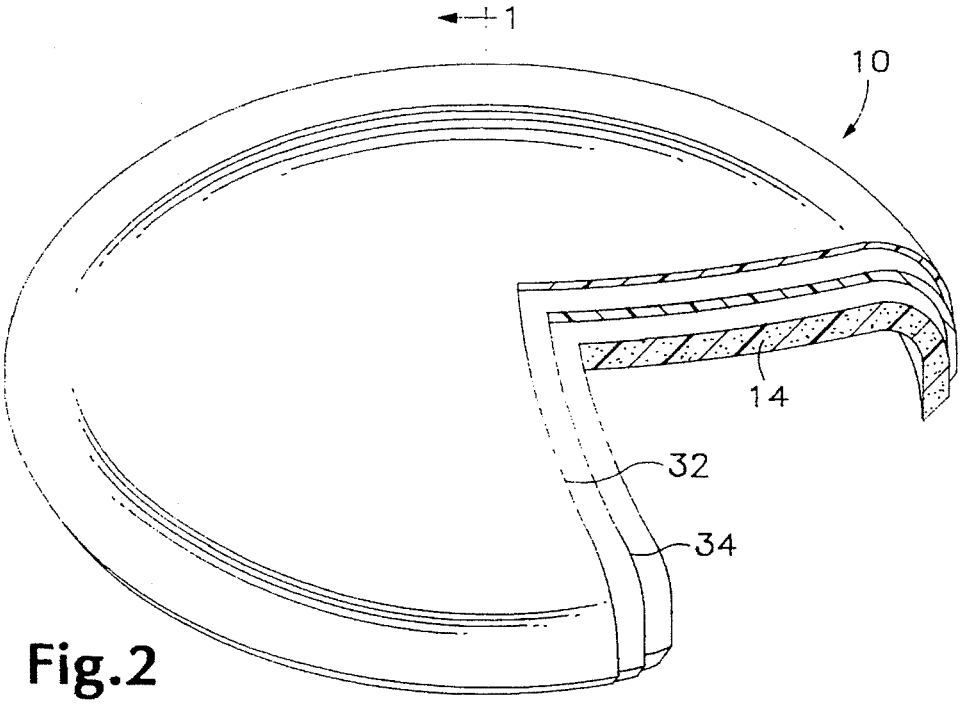
FIG. 2 is a partially sectioned isometric view of the flying disc water toy of FIG. 1 taken at different depths to illustrate the varying composite layers making up the disc.

Referring collectively to FIGS. 1 and 2, a flying disc water toy made in accordance with a preferred embodiment of the invention is shown at 10. The toy can be described generally as comprising a rigid framework or armature 12 being substantially coextensive with and forming a support layer for a fluid absorbing outer body 14. The support layer may exist either above, below, or interior of the outer body and is integrally joined therewith. This combination provides for a rigid, fluid-absorbent airfoil whereby an absorbed fluid may be dispensed generally orthogonal to an axis of an imparted rotation of the toy during the toy's aerial flight to present a pleasing pinwheel-shaped pattern of dispersal.

More particularly, the preferred embodiment of the toy can be described as a plano-circular throwing disc 10 having an upper section or substantially rigid laminate forming a planar exoskeletal layer 12. Exoskeletal layer 12 coextensively covers a lower section, sandwich style, comprising a generally planar fluid absorbent body or underbelly layer 14 which terminates at a generally circular outer perimeter 16. It will be understood that while placement of the rigid exoskeletal layer over the absorbent underbelly layer is preferred, the invention is not limited to this orientation.

The fluid-absorbent underbelly layer 14 and the exoskeletal layer 12 are glued or heat laminated together in a sheet. The sheet is then vacuum or compression-molded to fold outer perimeter 16 downward in a smooth curve adjacent the outer perimeter 16 to define a circular void 18 immediately beneath underbelly layer 14. The molding process also forms an annular rim 22 and inner rim surface 20 which circumscribe disc 10 to define a fluid-controlling region. Annular rim 22 is interiorly bounded by smoothly rounded peripheral edge 24 which itself defines the outer boundary of central region 25 of the disc. The disc is then trimmed downwardly and inwardly, as by die cutting, around outer perimeter 16 at an angle to expose a terminal edge fluid-dispersal region adjacent to and extending below inner rim surface 20, shown in FIG. 1 as fluid-radiating perimetral edge 26. Edge 26 defines a circumferential edge which is subtantially, continuosly exposed along its length.

The molding process also imparts concavity to an upper surface 30 of exoskeletal layer 12 and imparts a corresponding convexity to a lower surface 28 of underbelly layer 14. The two surfaces are thus in parallel, generally planar relation to one another and provide disc 10 with a substantially uniform cross-sectional thickness with respect to all cross-sectional planes as shown in FIG. 1. This configuration, including outer perimeter 16, annular rim 22, peripheral edge 24, and concave upper surface 30, provides air foiling means together with an aerodynamic lift surface and has been found to improve the throwability of the toy under wet or dry conditions. Additionally, these elements form a manually grippable portion in the upper surface which conforms generally to the shape of the thrower's or catcher's hand, shown in dashed outline in FIG. 1 as 35, to facilitate use of the disc.

Fluid absorbing underbelly layer or body 14 can be made of any material that is capable of both quick absorption when immersed in a fluid, as when placed in a swimming pool, and also uniform release of the fluid when body 14 is tossed and spun. The preferred material to be used for this purpose is an open-cell polyurethane foam of an approximate density of two pounds per cubic foot (2 lb/ft$^3$). An appreciated advantage in the use of soft foam for fluid absorbing body 14 is the provision of an improved grippable lower surface 28 to enable tossing of the disc.

Figure 3:
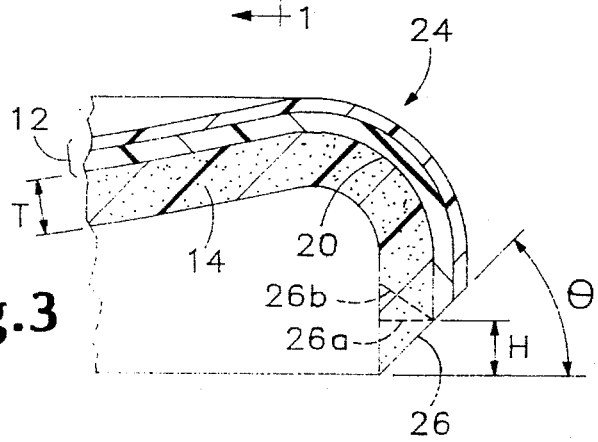
FIG. 3 is a front cross-sectional elevation expanded view of the peripheral edge and fluid-radiating perimetral edge of the flying disc water toy of FIG. 1.

Exoskeletal layer 12 can be made of any material sufficiently rigid to maintain the substantially planar form of body 14 during the fight of the disc. In its preferred embodiment, exoskeletal layer 12 includes a first, preferably upper laminate layer 32 and a, preferably lower laminate layer 34 which forms an intermediate layer between fluid-absorbent second layer 14. Layer 34 is interposed between and joined to first and second layers 32, 14 respectively, for supporting the same. As shown in FIGS. 1–3, first layer 32 and second layer 14 define outer surfaces of the disc. Upper and lower layers 32, 34 preferably are made of closed-cell foam materials of two different types, ranging in density from six pounds per cubic foot (6 lb/ft$^3$) to twelve pounds per cubic foot (12 lb/ft$^3$). In its most preferred embodiment, upper laminate layer 32 includes ethylene-vinyl-acetate (EVA) foam on whose surface a variety of colorful graphics may be printed. EVA is well-known in the art for its easy acceptance of dye to allow designs to be located on its outer surface. Lower laminate layer 34 includes a cross-linked foam material which is used to add an increased stiffness and structural support to exoskeletal layer 12. Exoskeletal layer 12 is preferably substantially impermeable to water so that when the water, acting under centrifugal forces, flows radially through spinning disc 10 a counteracting centripetal force exerted by inner rim surface 20 controls the dispersal of water from body 14.

To maintain stable and extended flight when the absorbent underbelly layer is saturated with fluid or completely dry, disc 10 should be dimensioned to certain preferable proportions. The diameter of disc 10 should be greater than approximately seven times its thickness in cross section. More preferably, the diameter should be more than fourteen times the thickness of the disc in cross section. The thickness of the underbelly layer should be substantially greater than the thickness of the exoskeletal layer. More preferably, the thickness of the underbelly layer is approximately three times the thickness of the exoskeletal layer. In its preferred embodiment, the underbelly thickness is approximately one-half inch (½") and the thickness of the exoskeletal layer is approximately three-sixteenths inch (3/16"), wherein the diameter of the disc is between approximately six and twelve inches (6"–12") and most preferably approximately nine inches (9").

FIG. 3 shows the fluid-dispersal features of disc 10 in greater detail. Radiating edge 26, which forms the terminal edge of underbelly layer 14, is preferably of a downwardly depending frusto-conical shape whose angle in cross section to horizontal, shown in FIG. 3 as angle θ, is approximately thirty degrees (30°) to sixty degrees (60°). Put another way, the cross section in a plane containing the rotation axis (FIG. 3) defines an angle θ of approximately 30– to 60– degrees between circumferential edge 26 and a line in the plane, passing through the circumferential edge and generally orthogonal to the rotation axis. The most preferable angle θ for frusto-conical radiating edge 26 is approximately forty-five degrees (45°) relative to horizontal. It is understood that angle θ is complementary to the radiating edge angle relative to vertical axis Z. The angled radiating edge consequently exposes an effective dispersal surface, normal to an axis of rotation of the toy, characterized by effective radiating thickness H which in one embodiment of the toy is equal to thickness T of fluid absorbent underbelly layer 14. Thus, water absorbed through lower surface 28 into fluid absorbing underbelly layer 14 is urged, by centrifugal forces created by the spinning of disc 10, toward inner rim surface 20. The impermeability of inner rim surface 20 causes a counteractive centripetal force upon the absorbed water to effect flow control of the water toward radiating edge 26. Importantly, water is not dispersed uncontrollably from edge 26 so as to splash, but instead its dispersal is in droplets that exit the annular surface of edge 26 along effective radiating thickness H. This produces a pleasing pinwheel appearance throughout the disc's flight (refer briefly to FIG. 4). Thus, acting in concert, underbelly layer 14, inner rim surface 20 and radiating edge 26 promote radial dispersal of a fluid absorbed within underbelly layer 14 when disc 10 is tossed with an imparted rotation about an axis substantially perpendicular to the plane of the disc.

In a disc of approximately nine inches (9") in diameter, a thickness T of approximately one-half inch (½") has been found to provide excellent fluid absorption and dispersal characteristics even when the fluid-radiating perimetral edge of underbelly layer 14 is in a horizontal orientation as shown by dashed line in FIG. 3 as edge 26*a*. Alternatively, radiating edge 26 may be upwardly depending, as shown by dashed line in FIG. 3 as edge 26*b*, to allow absorbed fluid to be flung outward from the disc.

Figure 4:
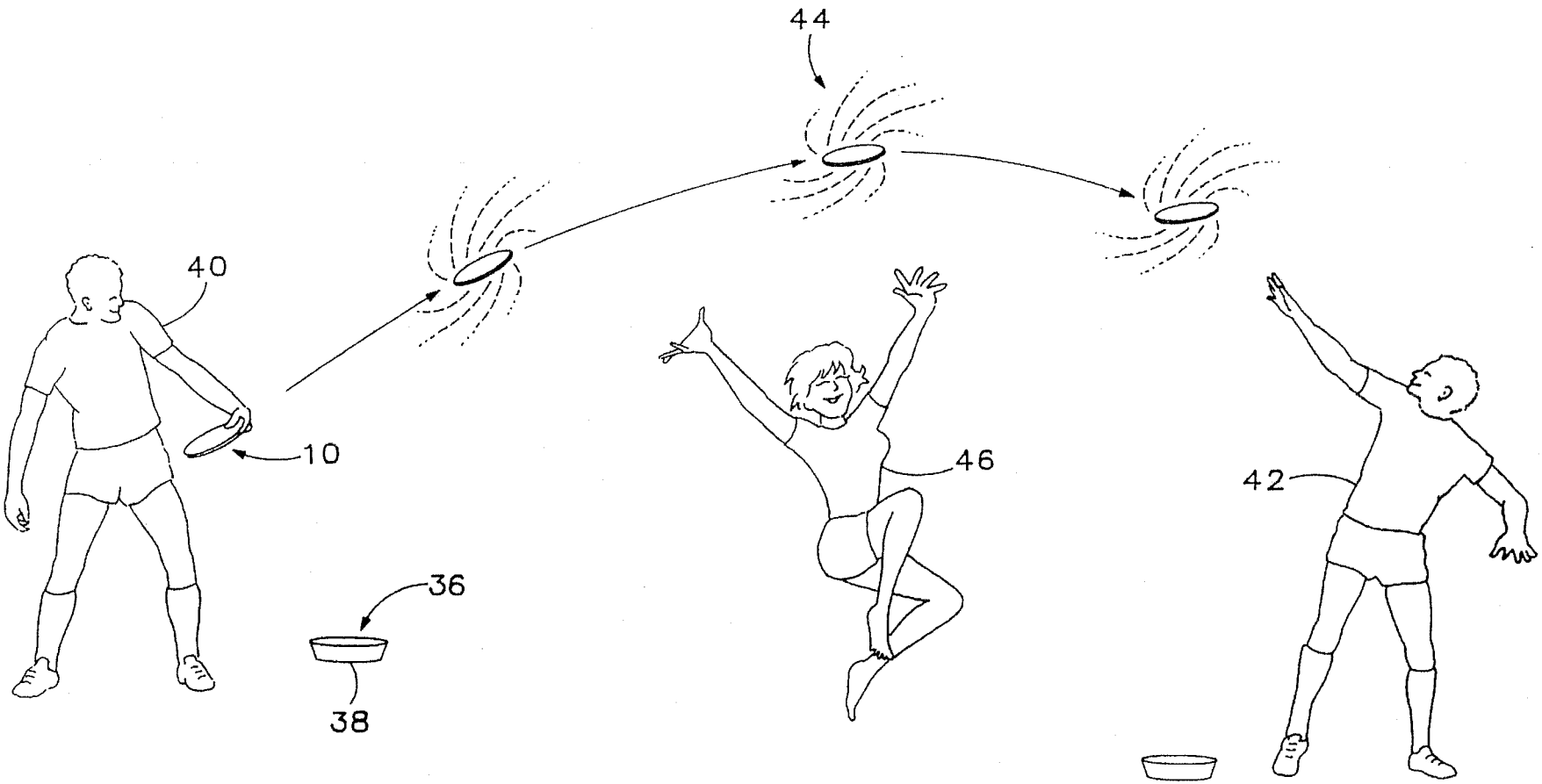
FIG. 4 is a perspective view of the flying disc water toy in use evenly dispersing water carried thereby in a pinwheel pattern throughout all portions of its flight as it spins and soars between a thrower and a catcher to the delight of all including an interested spectator. The disc is shown in the thrower's hand as well as in three positions along its arcing flight.

Referring now to FIG. 4, invented water disc toy 10 is shown in use to illustrate its achieved objects and advantages over conventional throwing discs and water toys. Disc 10 is dipped in water 36—shown, for clarity, as involving a water-containing pan 38 lying on the ground, whereas it will be appreciated that the thrower may be standing in a pool of water—to allow absorption to take place. Disc 10 is then tossed by a thrower 40 to a catcher 42 whereby the absorbed water is evenly dispersed in a pinwheel pattern 44 along a wide radial area over the flight path of the tossed disc (shown in three positions along the arcing arrows) to the delight of all, including a startled spectator 46.

Accordingly, while the preferred embodiment of the invention has been described, it will be appreciated that variations may be made without departing from the spirit and scope of the invention.

I claim:

1. A water toy for throwing and dispersing water comprising:

a rigid, generally fluid-impermeable first layer which includes a peripheral edge bounded by a generally circular outer perimeter defining a disc; and a fluid absorbent second layer connected to the first layer, wherein the second layer includes a terminal edge extending from adjacent the first layer's outer perimeter for promoting water dispersal in a radial direction when the disc is thrown, wherein the second layer's terminal edge defines a frusto-conically-shaped fluid dispersing lower surface, and further wherein the second layer's terminal edge extends downwardly from the first layer's outer perimeter, the first and second layers defining outer surfaces of the toy.

2. The toy of claim 1, wherein the first layer's peripheral edge is generally downturned.

3. The toy of claim 2 further comprising an intermediate layer interposed between and joined to the first and second layers for supporting the first and second layers.

4. The toy of claim 3, wherein the first and intermediate layers are made of a closed cell foam material.

5. The toy of claim 4, wherein the first and intermediate layers comprise a laminate of closed cell foam materials of two different types.

6. The toy of claim 5, wherein the first layer includes ethylene-vinylacetate foam and the intermediate layer includes a cross-linked polyethylene foam.

* * * * *